United States Patent [19]

Anderson

[11] B 3,997,992

[45] Dec. 21, 1976

[54] FILM RECORD CARD

[75] Inventor: Thomas P. Anderson, Hubbard Woods, Ill.

[73] Assignee: Microseal Corporation, Zion, Ill.

[22] Filed: Mar. 29, 1974

[21] Appl. No.: 456,153

[44] Published under the second Trial Voluntary Protest Program on March 9, 1976 as document No. B 456,153.

[52] U.S. Cl. ..... 40/159; 40/158 R

[51] Int. Cl.[2] ..... G09F 1/10

[58] Field of Search ..... 40/158 R, 158 B, 159, 40/104.19

[56] References Cited

UNITED STATES PATENTS

| | | | |
|---|---|---|---|
| 1,376,677 | 5/1921 | Coufal | 40/158 R X |
| 3,070,915 | 1/1963 | Walter | 40/158 R |
| 3,084,457 | 4/1963 | Schott | 35/66 |
| 3,089,270 | 5/1963 | Shoemaker | 40/158 R |
| 3,238,655 | 3/1966 | Engelstein | 40/159 |
| 3,339,303 | 9/1967 | Anderson | 40/159 |

*Primary Examiner*—Hugh R. Chamblee
*Assistant Examiner*—Wenceslao J. Contreras
*Attorney, Agent, or Firm*—Hill, Gross, Simpson, Van Santen, Steadman, Chiara & Simpson

[57] ABSTRACT

This invention is directed to film record cards and is more particularly directed to a film record card of the type wherein microfilm strips or the like are mounted in film pockets formed by two films overlying apertures of the film record card. These film strips are reproducible without being removed from the record card. At least part of one aperture is covered by a semi-opaque, ink-receptive coating serving as a reproducible index area.

2 Claims, 7 Drawing Figures

FILM RECORD CARD

BACKGROUND OF THE INVENTION

The use of microfilm records in conjunction with statistical cards has been ever increasing in recent years. Various means have been devised in the past for reproducing such microfilm records without removing them from the statistical card. However, an improved means has been sought permitting the inexpensive reproduction of the microfilm record contained in the statistical card and of indicia placed on the card in pencil, in ink or typewritten.

One prior-art structure requires that the entire statistical card be formed from a transparentized, reproducible material, and the entire card is reproduced along with the microfilm record contained therein. This method, however, is not always desirable and can be very costly. This invention provides a means of indexing microfilm records in a reproducible manner without incurring great cost.

SUMMARY OF THE INVENTION

A film record card is formed of card stock having at least one aperture. A pair of transparent films respectively overlie and underlie this aperture to form a film pocket, and at least part of one of these transparent films is treated to form a reproducible index area. The transparent films may be formed of a polyester material, and the reproducible index area may be formed by a semi-opaque, ink-receptive coating.

In another embodiment, more than one aperture is provided. At least one aperture thereof forms a film pocket or film pockets in the manner described above, and the reproducible index area is formed by coating at least part of a film over- or underlying one of these apertures in the manner described above. The coated film area may be integral with the transparent polyester film forming the microfilm pocket, or it may be a separate strip underlying or overlying the aperture or apertures forming the reproducible index area.

Other objects, featues and advantages of the invention will be readily apparent from the following description of certain preferred embodiments thereof, taken in conjunction with the accompanying drawings, although variations and modifications may be effected without departing from the spirit and scope of the novel concepts of the disclosure.

DESCRIPTION OF THE PREFERRED EMBODIMENTS

Figure 1:
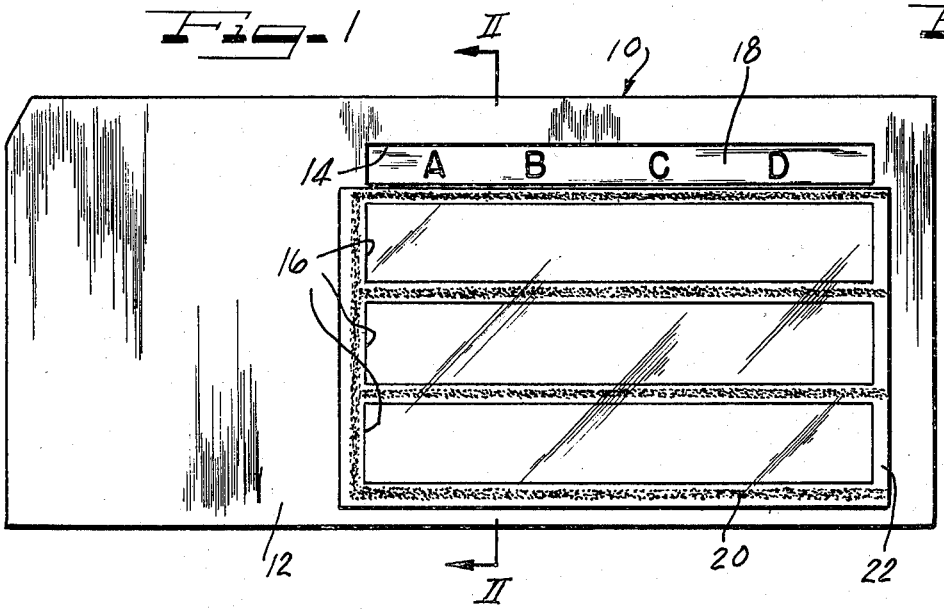
FIG. 1 is a plan view of a preferred embodiment of the film record card according to this invention whereby the index area is integral with the polyester sheet forming the rear of the microfilm pocket.
Figure 2:
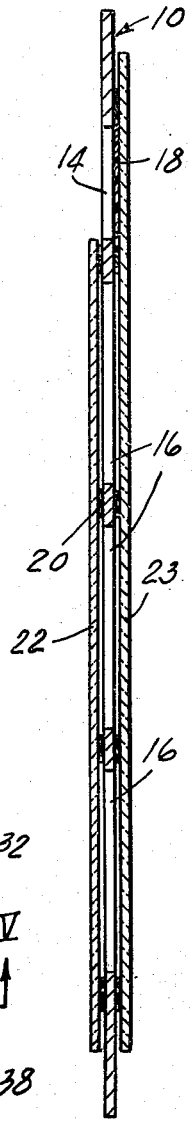
FIG. 2 is a sectional view of the arrangement according to FIG. 1 taken along lines II—II.

According to a preferred embodiment of this invention, a film record card, generally indicated at 10, consists of card stock 12 provided with at least two apertures 14 and 16, as is particularly shown in FIGS. 1 and 2. Aperture 14 defines the reproducible index area, and apertures 16 define the film receiving areas. Layers of adhesive 20 hold transparent films 22 and 23 respectively overlie and underlie at least the apertured portions 16 of the film record card 10. As shown in FIG. 2, the film 22 overlies only the apertures 16 forming the film pockets while film 23 has been extended to underly aperture 14 also. The area of film 23 underlying aperture 14 carries a semi-opaque, ink-receptive coating 18.

Figure 3:
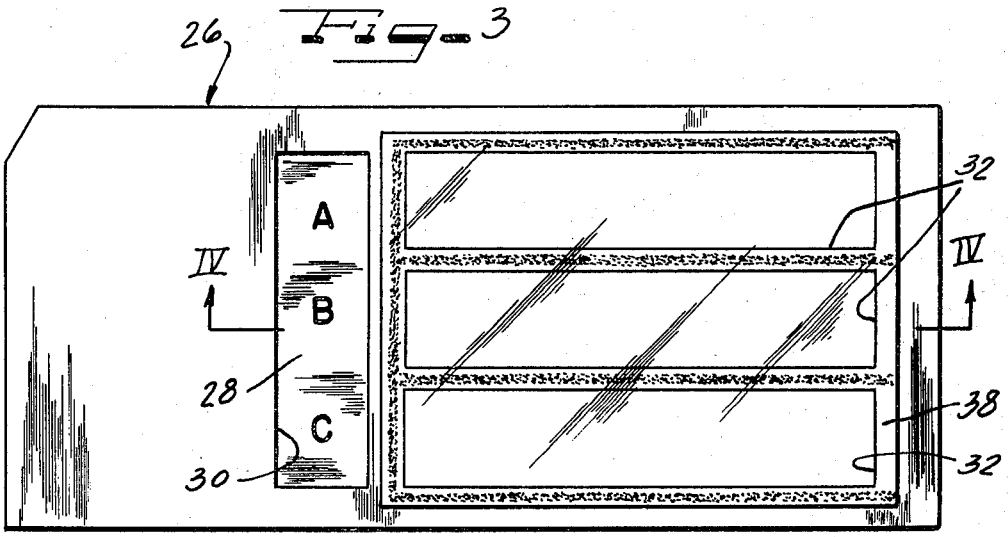
FIG. 3 is a plan view of an embodiment whereby the index area is applied separate from the sheets forming the pockets.
Figure 4:
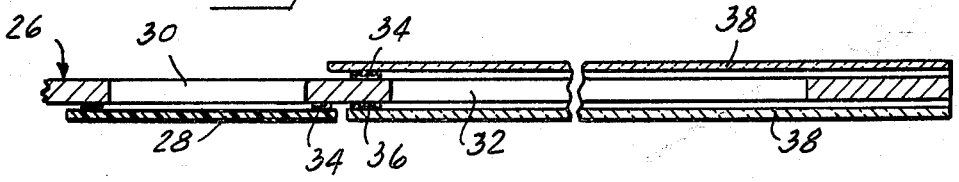
FIG. 4 is a partial sectional view taken along lines IV—IV of FIG. 3.

FIGS. 3 and 4 show another embodiment of a film record card according to this invention, generally indicated at 26. Here, a separate strip 28, made of a semi-opaque, ink-receptive material, overlies aperture 30, forming the reproducible index area held by a layer of adhesive 34. Apertures 32 are formed in the same manner as described above with layers of adhesive 36 holding transparent films 38 overlying and underlying apertures 32 to form microfilm pockets.

Figure 5:
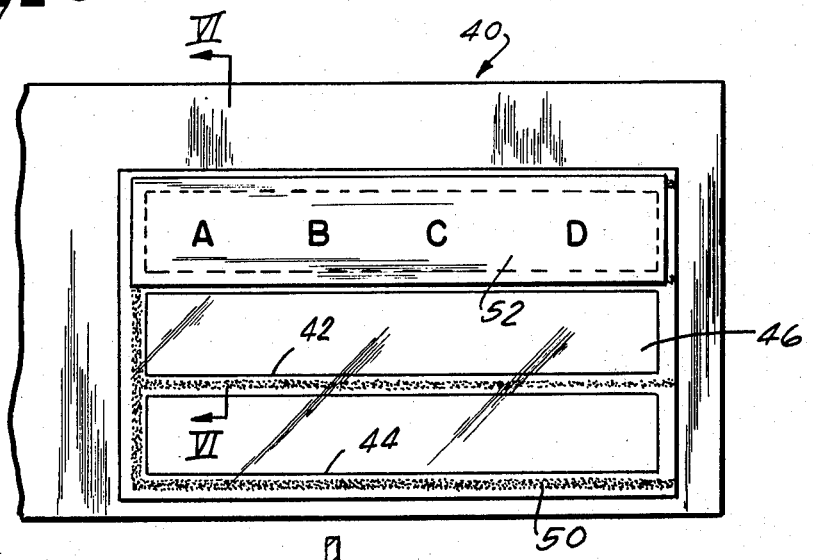
FIG. 5 is a partial view of an embodiment where the index area is constituted by a coating on one of the film pockets.
Figure 6:
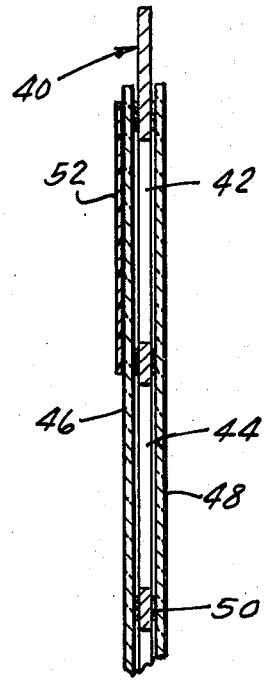
FIG. 6 is a partial sectional view taken along lines VI—VI of FIG. 5.

In FIGS. 5 and 6, a film record card 40 comprises apertures 42 and 44 with transparent films 46 and 48 overlying and underlying them, repsectively, held by a layer of adhesive 50. The reproducible index area is formed within aperture 42 whereby a semi-opaque, ink-receptive coating 52 is applied to the area transparent film 46 overlying aperture 42. This coating 52 may be an opaque, adhesvie strip of a coating similar to those of the embodiments of FIGS. 1 through 4.

Figure 7:
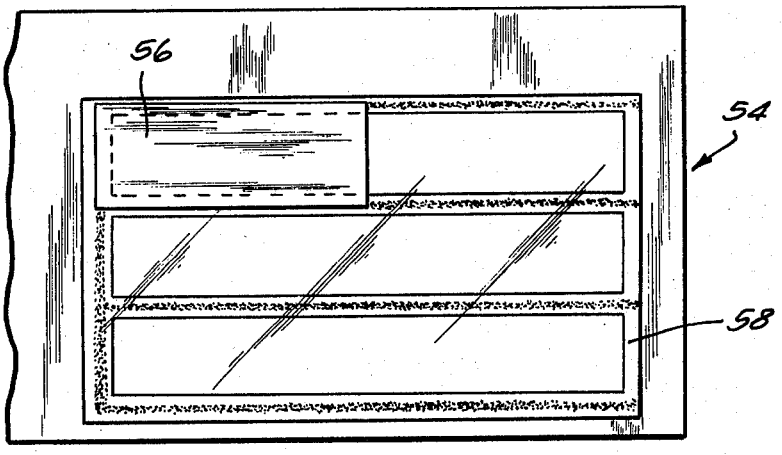
FIG. 7 is a partial plan view of an embodiment where the index area is constituted by a coating on part of one of the film pockets.

FIG. 7 is an embodiment 54 whereby the reproducible index coating 56 has been applied only partially to the film 58 overlying the aperture 50.

It will be apparent from the above description of the preferred embodiments that this invention provides a simple, practical and effective method for reproducibly indexing film record cards containing microfilm strips therein without removing the microfilm strips from the record card and without incurring great cost. Although there may be variations and modifications made by those skilled in the art, it is my desire to include these variations and modifications within the scope of my invention as defined in the appended claims.

I claim:

1. A microfilm record card comprising:

a card stock having a plurality of apertures formed therein, a first transparent enveloping member secured to one face of said card stock and underlying all of said apertures, a translucent semi-opaque ink receptive coating carried directly on at least one portion of said enveloping member and disposed within the area defined by at least one of said apertures to accommodate the reception of inked indicia, and a second transparent enveloping member overlying all of said apertures but for those exposing said translucent semi-opaque ink receptive coating carried on said first mentioned enveloping member, whereby said enveloping members define film pockets at each of said apertures but for those exposing said ink receptive coating.

2. The microfilm record card as defined in claim 1 wherein said translucent semi-opaque ink receptive coating is carried on the side of the first mentioned enveloping member adhered to said first mentioned face of said card stock.

* * * * *